US008599114B2

(12) United States Patent
Kim et al.

(10) Patent No.: US 8,599,114 B2
(45) Date of Patent: Dec. 3, 2013

(54) PIXEL AND ORGANIC LIGHT EMITTING DISPLAY DEVICE USING THE SAME

(75) Inventors: Yang-Wan Kim, Yongin (KR); Woong-Sik Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 963 days.

(21) Appl. No.: 12/686,885

(22) Filed: Jan. 13, 2010

(65) Prior Publication Data

US 2010/0253608 A1 Oct. 7, 2010

(30) Foreign Application Priority Data

Apr. 2, 2009 (KR) ..... 10-2009-0028438

(51) Int. Cl.
*G09G 3/30* (2006.01)
*G09G 3/36* (2006.01)
*G09G 5/00* (2006.01)

(52) U.S. Cl.
USPC ..... 345/76; 345/92; 345/211

(58) Field of Classification Search
USPC ..... 345/76–77
See application file for complete search history.

(56) References Cited

U.S. PATENT DOCUMENTS

| | | | | |
|---|---|---|---|---|
| 8,054,258 | B2 * | 11/2011 | Choi et al. | 345/82 |
| 8,174,518 | B2 * | 5/2012 | Kwon | 345/214 |
| 2006/0017668 | A1 * | 1/2006 | Shirasaki et al. | 345/76 |
| 2006/0221662 | A1 * | 10/2006 | Park et al. | 365/145 |
| 2006/0267886 | A1 * | 11/2006 | Ozaki et al. | 345/76 |
| 2007/0040772 | A1 * | 2/2007 | Kim | 345/76 |
| 2008/0111804 | A1 * | 5/2008 | Choi et al. | 345/205 |
| 2008/0180365 | A1 * | 7/2008 | Ozaki | 345/76 |
| 2008/0224965 | A1 * | 9/2008 | Kim | 345/76 |
| 2008/0231562 | A1 * | 9/2008 | Kwon | 345/77 |
| 2009/0027376 | A1 * | 1/2009 | Kwon | 345/214 |
| 2009/0051628 | A1 * | 2/2009 | Kwon | 345/77 |
| 2009/0184896 | A1 * | 7/2009 | Kwon | 345/76 |

FOREIGN PATENT DOCUMENTS

| | | | |
|---|---|---|---|
| CN | 1835058 | A | 9/2006 |
| CN | 101221727 | A | 7/2008 |
| CN | 101266757 | A | 9/2008 |
| CN | 101373578 | A | 2/2009 |

(Continued)

OTHER PUBLICATIONS

EPO Office Action and Extended Search Report for corresponding European Patent Application No. 10155346.9, dated Aug. 5, 2011, 11 pages.

(Continued)

*Primary Examiner* — Amare Mengistu
*Assistant Examiner* — Sarvesh J Nadkarni
(74) *Attorney, Agent, or Firm* — Christie, Parker & Hale, LLP

(57) ABSTRACT

A display device displays an image having a substantially uniform brightness by compensating for variations of the threshold voltages of driving transistors and compensating for the deterioration of an organic light emitting diode. A pixel includes an organic light emitting diode, two transistors, a storage capacitor, and a compensation unit. A driving transistor supplies a current to an OLED corresponding to the voltage in the storage capacitor. The compensation unit controls a voltage of a gate electrode of the driving transistor corresponding to a deterioration of the organic light emitting diode, and couples one electrode of the driving transistor to the data line during a compensation period, during which a threshold voltage of the driving transistor is compensated.

22 Claims, 7 Drawing Sheets

(56) References Cited

FOREIGN PATENT DOCUMENTS

| | | | |
|---|---|---|---|
| EP | 1 923 857 | A2 | 5/2008 |
| JP | 2004-252110 | | 9/2004 |
| JP | 2005-189695 | | 7/2005 |
| JP | 2006-38963 | | 2/2006 |
| JP | 2006-330138 | | 12/2006 |
| JP | 2008-122906 | | 5/2008 |
| JP | 2009-31712 | | 2/2009 |
| JP | 2009-53647 | | 3/2009 |
| KR | 10-2003 0081919 | A | 10/2003 |
| KR | 1020050110961 | A | 11/2005 |
| KR | 1020060054603 | A | 5/2006 |
| KR | 100815756 | B1 | 3/2008 |
| KR | 10-0821041 | | 4/2008 |
| KR | 10-0844770 | | 7/2008 |
| KR | 1020080080753 | A | 9/2008 |
| WO | WO 2007/037269 | A1 | 4/2007 |

OTHER PUBLICATIONS

JPO Office Action dated Jan. 4, 2012, for corresponding Japanese Patent Application No. 2009-203427, listing the references cited under "Foreign Patent Documents," 2 pages.

Chinese Office action dated Mar. 19, 2012 for corresponding Chinese Patent Application No. 201010115154.7, 8pp.

Korean Office Action dated Jul. 7, 2011 for corresponding Korean priority application No. KR 10-2009-0028438.

SIPO Certificate of Patent dated Jan. 13, 2013, for corresponding Chinese Patent application 201010115154.7, (3 pages).

* cited by examiner

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2009-0028438, filed on Apr. 2, 2009, in the Korean Intellectual Property Office, the entire content of which is incorporated herein by reference.

BACKGROUND

1. Field

The present invention relates to a pixel and an organic light emitting display device using the same.

2. Discussion of Related Art

Recently, various flat panel display devices that are lighter in weight and smaller in volume than a cathode ray tube, have been developed. Among the flat panel display devices, there are liquid crystal display devices, field emission display devices, plasma display panels, and organic light emitting display devices, etc.

Among the flat panel display devices, the organic light emitting display devices display images using organic light emitting diodes that generate light by a recombination of electrons and holes. Organic light emitting display devices are driven at low power consumption, with rapid response speed.

FIG. 1 is a schematic circuit diagram showing a pixel of a conventional organic light emitting display device.

Referring to FIG. 1, the pixel 4 of the conventional organic light emitting display device includes an organic light emitting diode OLED, and a pixel circuit 2 that is coupled to a data line Dm and a scan line Sn to control the organic light emitting diode OLED.

The anode electrode of the organic light emitting diode OLED is coupled to the pixel circuit 2, and the cathode electrode of the organic light emitting diode OLED is coupled to a second power supply ELVSS. The pixel circuit 2 controls the amount of current supplied to the organic light emitting diode OLED according to the data signal supplied to the data line Dm when a scan signal supplied to the scan line Sn. To this end, the pixel circuit 2 includes a second transistor M2 coupled between a first power supply ELVDD and the organic light emitting diode OLED, a first transistor M1 coupled between the second transistor M2, the data line Dm, and the scan line Sn, and a storage capacitor Cst that is coupled between the gate electrode and a first electrode of the second transistor M2.

The gate electrode of the first transistor M1 is coupled to the scan line Sn, and a first electrode of the first transistor M1 is coupled to the data line Dm. A second electrode of the first transistor M1 is coupled to one terminal of the storage capacitor Cst. Here, the first electrode of the first transistor M1 is either a source electrode or a drain electrode, and the second electrode is an electrode other than the electrode of the first electrode. For example, if the first electrode is the source electrode, the second electrode is the drain electrode. When the scan signal is supplied to the scan line Sn, the first transistor M1 coupled between the scan line Sn and the data line Dm is turned on to supply the data signal supplied from the data line Dm to the storage capacitor Cst. Thus, the storage capacitor Cst is charged with a voltage corresponding to the data signal.

The gate electrode of the second transistor M2 is coupled to one terminal of the storage capacitor Cst, and the first electrode is coupled to the other terminal of the storage capacitor Cst and the first power supply ELVDD. The second electrode of the second transistor M2 is coupled to the anode electrode of the organic light emitting diode OLED. The second transistor M2 controls the amount of current flowing from the first power supply ELVDD to the second power supply ELVSS via the organic light emitting diode OLED in accordance with the voltage stored in the storage capacitor Cst. Accordingly, the organic light emitting diode OLED generates light corresponding to the amount of current supplied by the second transistor M2.

However, an issue with the conventional organic light emitting display device as described above is that an image having a desired brightness cannot be displayed due to changes in efficiency according to the deterioration of the organic light emitting diode OLED. That is, the organic light emitting diode OLED deteriorates as time elapses, and accordingly, light having a gradually lowering brightness is generated corresponding to the same data signal. Another issue with the conventional organic light emitting display device is that an image having a uniform brightness cannot be displayed due to the non-uniformity in threshold voltage/mobility of the driving transistors M2 included in each pixel 4.

SUMMARY

An aspect of an embodiment of the present invention is directed toward an organic light emitting display having pixels that display images having a substantially uniform brightness by compensating for variations in the threshold voltage of driving transistors outside the pixels and compensating for the deterioration of organic light emitting diodes inside the pixels. Another aspect of an embodiment of the present invention is directed toward a pixel having a driving transistor and an organic light emitting diode, where the pixel compensates a threshold voltage/mobility of the driving transistor, and compensates for the deterioration of the organic light emitting diode.

According to one embodiment, a pixel includes an organic light emitting diode, first and second transistors, a storage capacitor, and a compensation unit. The first transistor is coupled to a scan line and a data line, and is configured to be turned on when a scan signal is supplied to the scan line. The storage capacitor stores a voltage corresponding to a data signal supplied to the data line. The second transistor supplies a current corresponding to the voltage stored in the storage capacitor, the current flowing from a first power supply to a second power supply via the organic light emitting diode. The compensation unit controls the voltage of a gate electrode of the second transistor corresponding to a deterioration of the organic light emitting diode, and couples a first electrode of the second transistor to the data line during a compensation period in which a threshold voltage of the second transistor is compensated.

In one embodiment, the compensation unit includes third through fifth transistors, and a feedback capacitor. The fourth and fifth transistors are coupled between the first electrode of the second transistor and the data line. The third transistor is coupled between a first node and a voltage source, the first node being a common terminal of the fourth transistor and the fifth transistor. The feedback capacitor is coupled between the first node and the gate electrode of the second transistor. The gate electrode of the fifth transistor may be coupled to a control line substantially parallel to the scan line, such that the fifth transistor is configured to be turned on during the compensation period.

The gate electrode of the fourth transistor may be coupled to the scan line and is configured to be turned on during the compensation period concurrently with the fifth transistor. A gate electrode of the third transistor may be coupled to an emission control line substantially parallel to the scan line. A turn-on time of the third transistor does not overlap with a turn-on time of the fourth transistor during a normal driving period.

According to one embodiment of the present invention, an organic light emitting display device includes a plurality of scan lines, emission control lines, and control lines extending across a display region, and a plurality of data lines extending across the display region to cross the scan lines, emission control lines, and control lines. A plurality of pixels are at respective crossings of the scan lines, emission control lines, and data lines. Further, the display device includes a scan driver, control line driver, data driver, a sensing unit, a switching unit, a control block, and a timing controller. The scan driver sequentially supplies scan signals to the scan lines during a compensation period for compensating a threshold voltage and during a normal driving period, and sequentially supplies emission control signals to the emission control lines during the normal driving period. The control line driver sequentially supplies control signals to the control lines during the compensation period. The data driver supplies data signals to the data lines, the data signals corresponding to second data supplied from a timing controller. The sensing unit senses threshold voltage/mobility information of driving transistors in respective ones of the pixels. The switching unit selectively couples the sensing unit and/or the data driver to the data lines. The control block stores the threshold voltage/mobility information of the driving transistors sensed by the sensing unit. The timing controller generates the second data by in accordance with first data supplied from an external source utilizing the threshold voltage/mobility information stored in the control block. Each of the respective pixels includes an organic light emitting diode and a compensation unit that couples a respective one of the driving transistors to a respective one of the data lines during the compensation period and compensates for a deterioration of the organic light emitting diode during the normal driving period.

In one embodiment, the sensing unit includes a current sink unit for sinking a first current from a specific pixel of the pixels via a specific driving transistor of the driving transistors, and an analog-digital converter for converting a first voltage to a first digital value, the first voltage generated when the first current is sunken.

The switching unit may include a second switching element positioned between the current sink unit and the data line, the second switching element configured to be turned on during the compensation period, and a first switching element positioned between the data driver and the data line, the first switching element configured to be turned on during the normal driving period.

The control block may include a memory for storing the first digital value, and a control unit for transferring the first digital value to the timing controller. The control unit may be configured to transfer the first digital value generated from a specific pixel of the pixels to the timing controller when the first data to be supplied to the specific pixel is input to the timing controller.

The timing controller may be configured to generate the second data having j bits (j is a natural number greater than i) based on the first data having i bits (i is a natural number) utilizing the first digital value to compensate the threshold voltage/mobility. During the normal driving period, the scan driver may be configured to supply a first emission control signal of the emission control signals to a first emission control line of the emission control lines, the first emission control signal at least partially overlapping a first scan signal of the scan signals, the first scan signal supplied to a first scan line of the scan lines corresponding to the first emission control line, and having a wider width than a width of the first scan signal. During the compensation period, the control line driver may be configured to supply a first control signal of the control signals to a first control line of the control lines concurrently with a second scan signal of the scan signals supplied to a second scan line of the scan lines corresponding to the first control line.

With the pixel and the organic light emitting display device using the same according to various embodiments of the present invention, the deviation in the threshold voltages of driving transistors generated by variations in manufacturing processes is compensated outside the pixels. Here, the transistors and other components for compensating for the threshold voltage are not inside the pixel. Also, in various embodiments of the present invention, a compensation unit is additionally installed inside each of the pixels, thus compensating for the deterioration of the organic light emitting diode and displaying an image having a substantially uniform brightness accordingly.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
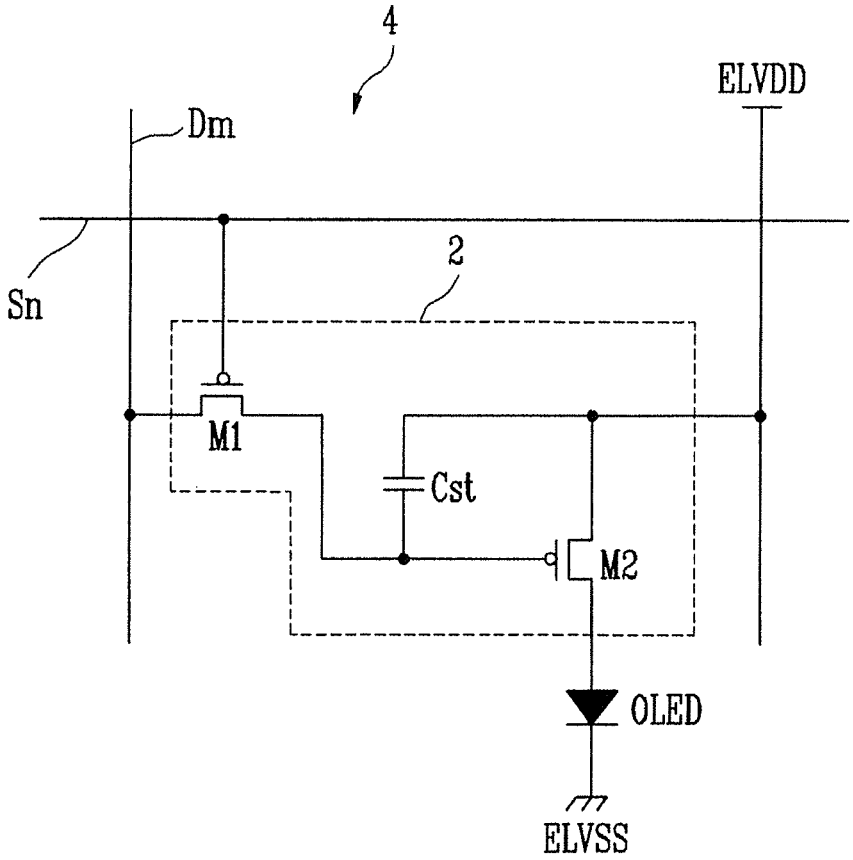
FIG. 1 (PRIOR ART)
FIG. 1 is a schematic circuit diagram showing a pixel of a conventional organic light emitting display device.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "connected" or "coupled" to another element, it can be directly connected or coupled to the another element or be indirectly connected or coupled to the another element with one or more intervening elements interposed therebetween. Like reference numerals designate like elements throughout the specification.

Hereinafter, exemplary embodiments of the present invention, proposed so that a person having ordinary skill in the art can easily carry out the present invention, will be described in more detailed with reference to the accompanying FIG. 2 to FIG. 8.

Figure 2:
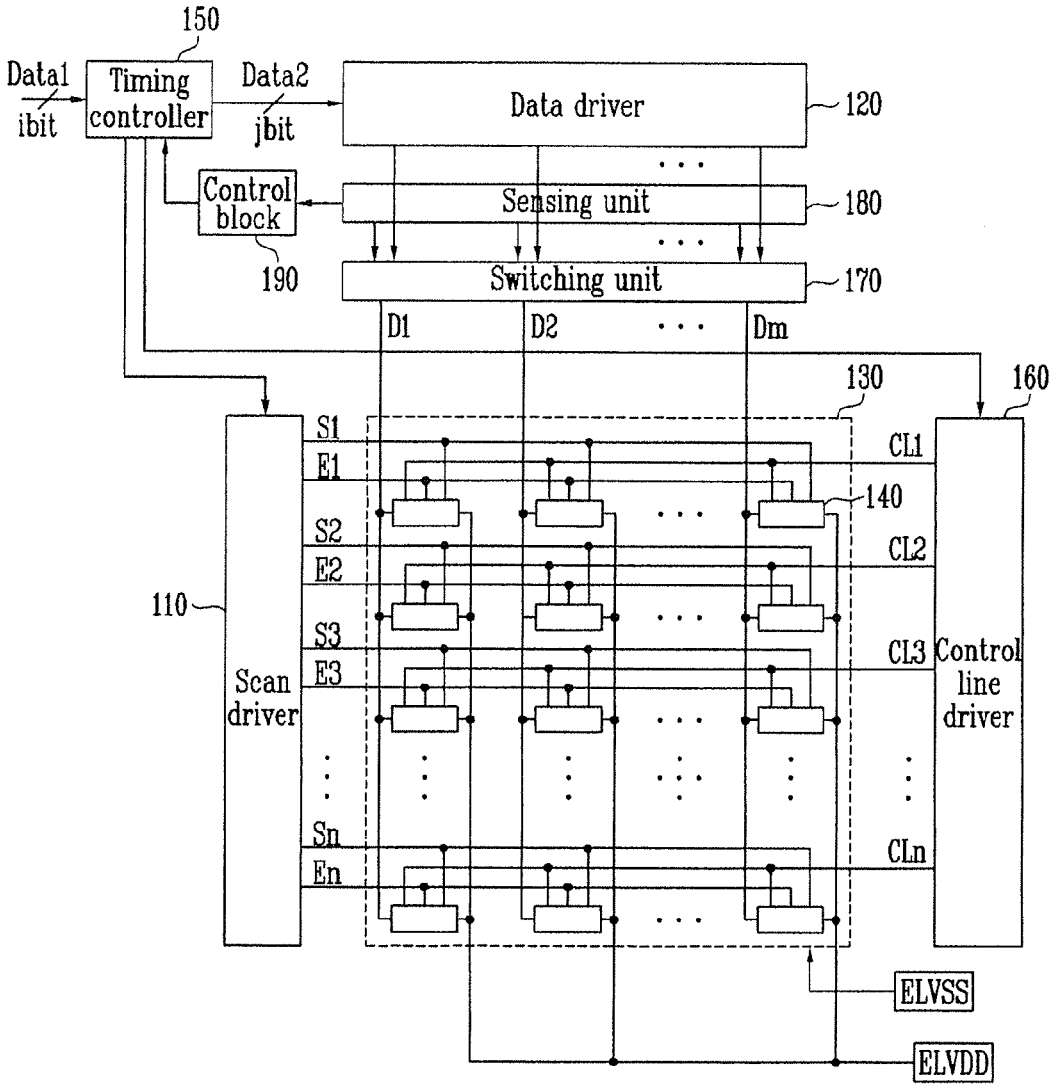
FIG. 2 is a schematic block diagram showing an organic light emitting display device according to an embodiment of the present invention.

FIG. 2 is a schematic block diagram showing an organic light emitting display device according to an exemplary embodiment of the present invention.

Referring to FIG. 2, the organic light emitting display device according to the exemplary embodiment of the present invention includes a display region 130 that includes pixels 140 coupled to scan lines S1 to Sn, emission control lines E1 to En, control lines CL1 to CLn, and data lines D1 to Dm, a scan driver 110 that drives the scan lines S1 to Sn and emission control lines E1 to En, a control line driver 160 that drives the control lines CL1 to CLn, a data driver 120 that drives the data lines D1 to Dm, and a timing controller 150 that controls the scan driver 110, the data driver 120, and the control line driver 160.

The organic light emitting display device according to the exemplary embodiment of the present invention further includes a sensing unit 180 that extracts threshold voltage/mobility information of driving transistors included in the respective pixels 140, a switching unit that selectively couples the sensing unit 180 and the data driver 120 to the data lines D1 to Dm, and a control block 190 that stores the information sensed by the sensing unit 180.

The display region 130 includes the pixels 140 positioned at crossings of the scan lines S1 to Sn, the emission control lines E1 to En, the control lines CL1 to CLn, and the data lines D1 to Dm. The pixels 140 receive a first power ELVDD and a second power ELVSS from an external source. The pixels 140 control an amount of current supplied from the first power ELVDD to the second power ELVSS via the organic light emitting diode in accordance with the data signals. In some embodiments, compensation units (e.g., compensation unit 142 of FIG. 3) are installed in each of the pixels 140 to compensate for the deterioration of the organic light emitting diode.

The scan driver 110 sequentially supplies the scan signals to the scan lines S1 to Sn in accordance with the control of the timing controller 150. Also, the scan driver 110 supplies the emission control signals to the emission control lines E1 to En in accordance with the control of the timing controller 150.

The control line driver 160 sequentially supplies the control signals to the control lines CL1 to CLn in accordance with the control of the timing controller 150.

The data driver 120 supplies the data signals to the data lines D1 to Dm in accordance with the control of the timing controller 150.

The switching unit 170 selectively couples the sensing unit 180 and the data driver 120 to the data lines D1 to Dm. To this end, the switching unit 170 has at least one switching element coupled to each of the data lines D1 to Dm, respectively (that is, in each channel).

The sensing unit 180 extracts threshold voltage/mobility information of driving transistors included in each of the pixels 140, and supplies the extracted threshold voltage/mobility information to the control block 190. To this end, the sensing unit 180 has a current sink unit (e.g., current sink unit 181 in FIG. 5) coupled to each of the data lines D1 to Dm, respectively (that is, in each channel).

The control block 190 stores the threshold voltage/mobility information supplied by the sensing unit 180. In some embodiments, the control block 190 stores threshold voltage/mobility information of driving transistors included in all pixels 140. To this end, the control block 190 has a memory and a control unit that transfers the information stored in the memory to the timing controller 150.

The timing controller 150 controls the data driver 120, the scan driver 110, and the control driver 160. Also, the timing controller 150 generates a second data Data2 by converting a digital value of a first data Data1 input from an external source corresponding to the information supplied by the control block 190 so that the threshold voltage/mobility of the driving transistor is compensated. Here, the first data Data1 has i bits (i is a natural number), and the second data Data2 has j bits (j is a natural number of i or more).

The second data Data2 generated by the timing controller 150 is supplied to the data driver 120. Then, the data driver 120 generates data signals using the second data Data2, and supplies the generated data signals to the pixels 140.

Figure 3:
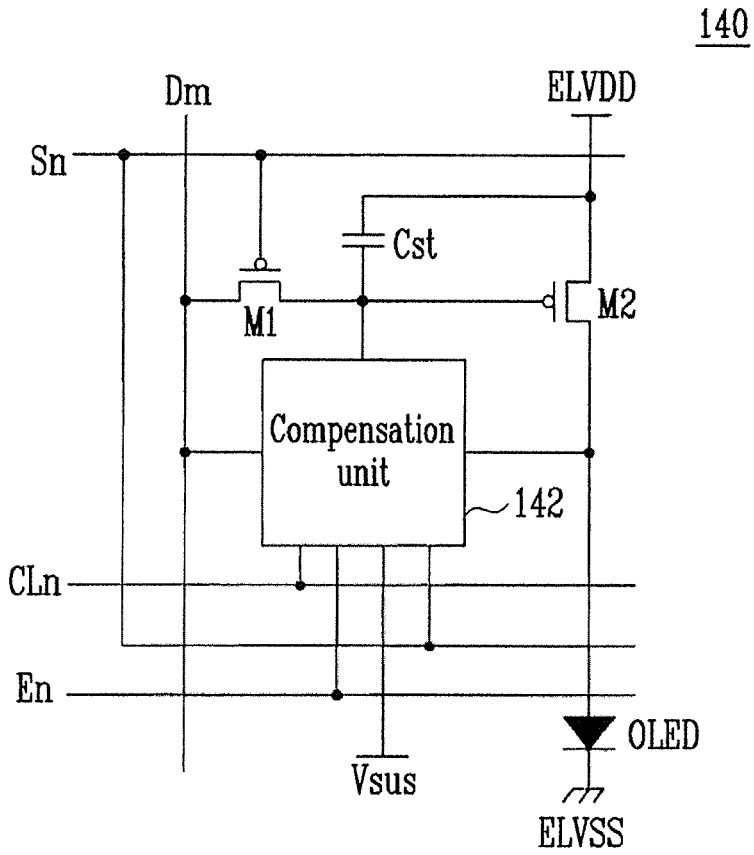
FIG. 3 is a schematic circuit diagram showing an embodiment of the pixel of FIG. 2.

FIG. 3 is a schematic circuit diagram showing an exemplary embodiment of the pixel 140 of FIG. 2. For convenience of explanation, the pixel 140 coupled to an $n^{th}$ scan line Sn and an $m^{th}$ data line (Dm) will be described in FIG. 3.

Referring to FIG. 3, the pixel 140 according to the embodiment of the present invention includes a first transistor M1 that is coupled to an organic light emitting diode OLED, a scan line Sn, and a data line Dm, a second transistor M2 that controls the amount of current supplied to the organic light emitting diode OLED corresponding to the voltage stored in a storage capacitor Cst, and a compensation unit 142 that selectively couples the second electrode of the second transistor M2 to the data line Dm and simultaneously or concurrently compensates for the deterioration of the organic light emitting diode OLED.

The anode electrode of the organic light emitting diode OLED is coupled to a second electrode of the second transistor M2, and the cathode electrode of the organic light emitting diode OLED is coupled to a second power supply ELVSS. The organic light emitting diode OLED generates light having a brightness (e.g., a predetermined brightness) corresponding to the amount of current supplied by the second transistor M2.

A gate electrode of the first transistor M1 is coupled to the scan line Sn, and a first electrode of the first transistor M1 is coupled to the data line Dm. A second electrode of the first transistor M1 is coupled to a gate electrode of the second transistor M2 (a driving transistor). Thus, the first transistor M1 supplies the data signal from the data line Dm to the gate electrode of the second transistor M2 when the scan signal is supplied to the scan line.

The gate electrode of the second transistor M2 is coupled to the second electrode of the first transistor M1, and a first electrode of the second transistor M2 is coupled to a first power supply ELVDD. The second electrode of the second transistor M2 is coupled to the anode electrode of the organic light emitting diode OLED. The second transistor M2 controls the amount of current flowing from the first power supply ELVDD to the second power supply ELVSS via the organic light emitting diode OLED, the amount of current corresponding to the voltage applied to the gate electrode of the second transistor M2. To this end, the voltage of the first power supply ELVDD is set to be higher than the voltage of the second power supply ELVSS.

One terminal of the storage capacitor Cst is coupled to the gate electrode of the second transistor M2, and the other terminal of the storage capacitor Cst is coupled to the first power supply ELVDD. The storage capacitor Cst is charged with (e.g., stores) a voltage corresponding to the data signal when the first transistor M1 is turned on.

The compensation unit 142 controls the voltage of the gate electrode of the second transistor M2 corresponding to the deterioration of the organic light emitting diode OLED. In other words, the compensation unit 142 controls the voltage of the gate electrode of the second transistor M2 to compensate for the deterioration of the organic light emitting diode OLED. The compensation unit 142 couples the data line Dm to the second electrode of the second transistor M2 during a period when the threshold voltage information of the second transistor M2 is sensed.

To this end, the compensation unit 142 is coupled to a voltage source Vsus, a control line CLn, a scan line Sn, and an emission control line En. The voltage of the voltage source Vsus may vary so that the deterioration of the organic light emitting diode OLED can be compensated. For example, the voltage of the voltage source Vsus may be higher or lower than the anode voltage Voled of the organic light emitting diode OLED. Here, the voltage of the anode electrode Voled of the organic light emitting diode OLED, which is the voltage shown on the anode electrode of the organic light emitting diode OLED, varies in accordance with the deterioration of the organic light emitting diode OLED.

Figure 4:
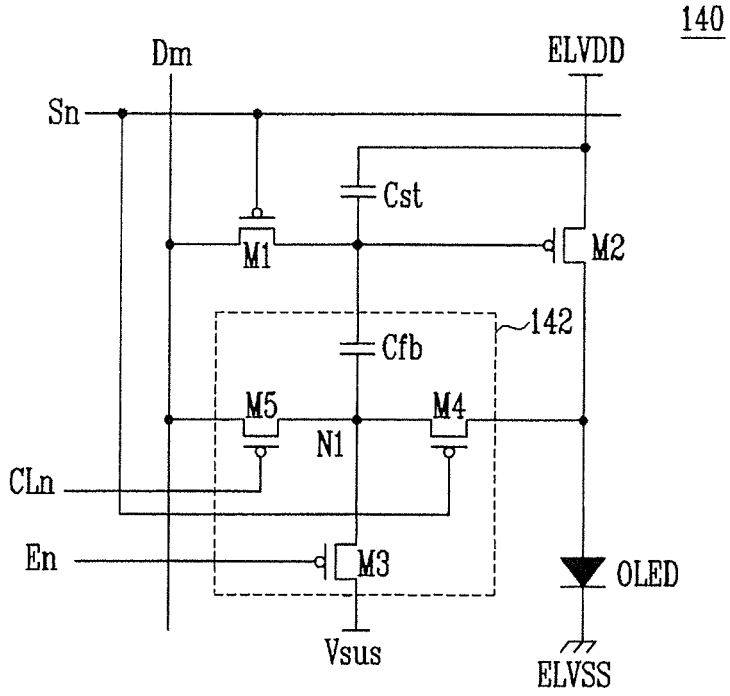
FIG. 4 is a schematic circuit diagram showing an embodiment of the compensation unit of FIG. 3.

FIG. 4 is a schematic circuit diagram showing an exemplary embodiment of the compensation unit of FIG. 3.

Referring to FIG. 4, the compensation unit 142 includes a fourth transistor M4 and a fifth transistor M5 that are coupled between the anode electrode of the organic light emitting diode OLED and the $m^{th}$ data line Dm. A third transistor M3 is coupled between a first node N1 and the voltage source Vsus, the first node N1 being a common node between the fourth transistor M4 and the fifth transistor M5. A feedback capacitor Cfb is coupled between the first node N1 and the gate electrode of the second transistor M2.

The fourth transistor M4 is positioned between the first node N1 and the anode electrode of the organic light emitting diode OLED, and is controlled by the scan signal on the scan line Sn.

The fifth transistor M5 is positioned between the first node N1 and the data line Dm, and is controlled by the control signal on the control line CLn.

The third transistor M3 is positioned between the first node N1 and the voltage source Vsus, and is controlled by the emission control signal on the emission control line En.

The feedback capacitor Cfb transfers the voltage variation of the first node N1 to the gate electrode of the second transistor M2.

In the compensation unit 142 described above, the fourth transistor M4 and the fifth transistor M5 simultaneously or concurrently maintain a turn-on state during a period when the threshold voltage of the second transistor M2 is sensed. The fourth transistor M4 and the fifth transistor M5 compensate for the deterioration of the organic light emitting diode OLED, while being alternately turned on and turned off during a period when they are normally driven (that is, a period when a predetermined image is displayed). The detailed explanation of the driving thereof will be described later in more detail.

Figure 5:
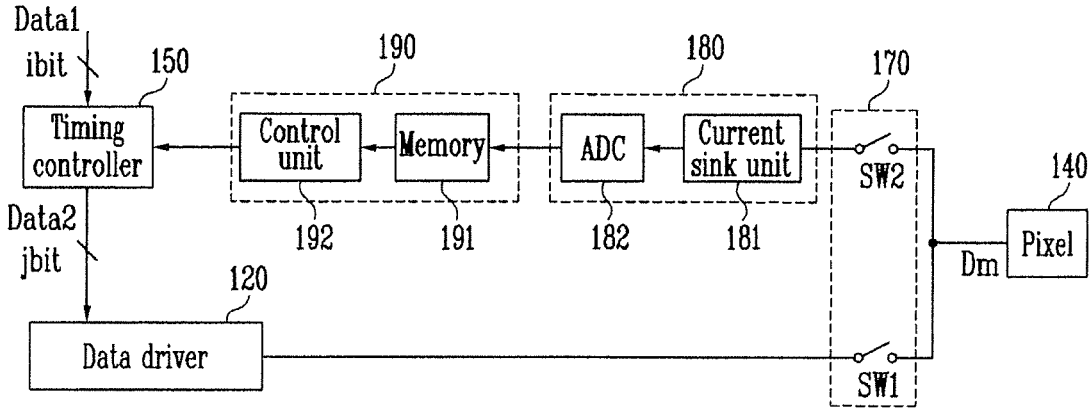
FIG. 5 is a schematic block diagram showing the switching unit, the sensing unit, and the control block of FIG. 2.

FIG. 5 is a schematic block diagram showing an exemplary embodiment of the switching unit 170, the sensing unit 180, and the control block 190 of FIG. 2. For convenience of explanation, FIG. 5 will show an embodiment where they are coupled to an $m^{th}$ data line Dm.

Referring to FIG. 5, two switching elements SW1 and SW2 are provided, that is, one on each channel of the switching unit 170. A current sink unit 181 and an analog-digital converter (hereinafter, referred to as "ADC") 182 are provided on each channel of the sensing unit 180. (Here, one ADC may be provided for each of a plurality of channels, or a plurality of channels, or all channels, may share one ADC.) The control block 190 further includes a memory 191 and a control unit 192.

The first switching element SW1 is positioned between the data driver 120 and the data line Dm. The first switching element SW1 is turned on when the data signal is supplied from the data driver 120. In other words, the switching element SW1 maintains a turn-on state during a period when the organic light emitting display device displays an image (e.g., a predetermined image).

The second switching element SW2 is positioned between the current sink unit 181 and the data line Dm. The second switching element SW2 maintains a turn-on state during a period when the threshold voltage/mobility information of the second transistor M2 is sensed.

The current sink unit 181 sinks a first current from the pixel 140 when the second switching element SW2 is turned on (e.g., closed), and supplies a voltage (e.g., a predetermined voltage) generated from the data line Dm when the first current is sunken from the pixel 140 to the ADC 182. Here, the first current is sunken via the second transistor M2 included in the pixel 140. Therefore, the voltage (e.g., the predetermined voltage or a first voltage) of the data line Dm generated by the current sink unit 181 corresponds to the threshold voltage/mobility information of the second transistor M2. In addition, the first current varies so that the first voltage can be applied, e.g., within a predetermined time. For example, the first current may have a value that flows to the organic light emitting diode OWED when the pixel 140 emits light at a maximum brightness.

The ADC 182 converts a value of the first current sunken into the current sink unit 181 into a first digital value.

The control block 190 includes a memory 191 and a control unit 192.

The memory 191 stores the first digital value supplied from the ADC 182. In some embodiments, the memory 191 stores the threshold voltage/mobility information of the respective second transistors M2 of all the pixels 140 included in the display region 130.

The control unit 192 transfers the first digital value stored in the memory 191 to the timing controller 150. Here, the control unit 192 transfers the first digital value to the timing controller 150, the first digital value being extracted from the pixel 140 to which a first data Data1, which is currently input to the timing controller 150, is to be supplied.

The timing controller 150 receives the first data Data1 from the external source, and receives the first digital value from the control unit 192. The timing controller 150 supplied with the first digital value generates second data Data2 by converting the bit value of the first data Data1 so that the threshold voltage/mobility of the second transistor M2 included in the pixel 140 can be compensated.

The data driver 120 generates the data signal utilizing the second data Data2 and supplies the generated data signal to the pixel 140.

Figure 6:
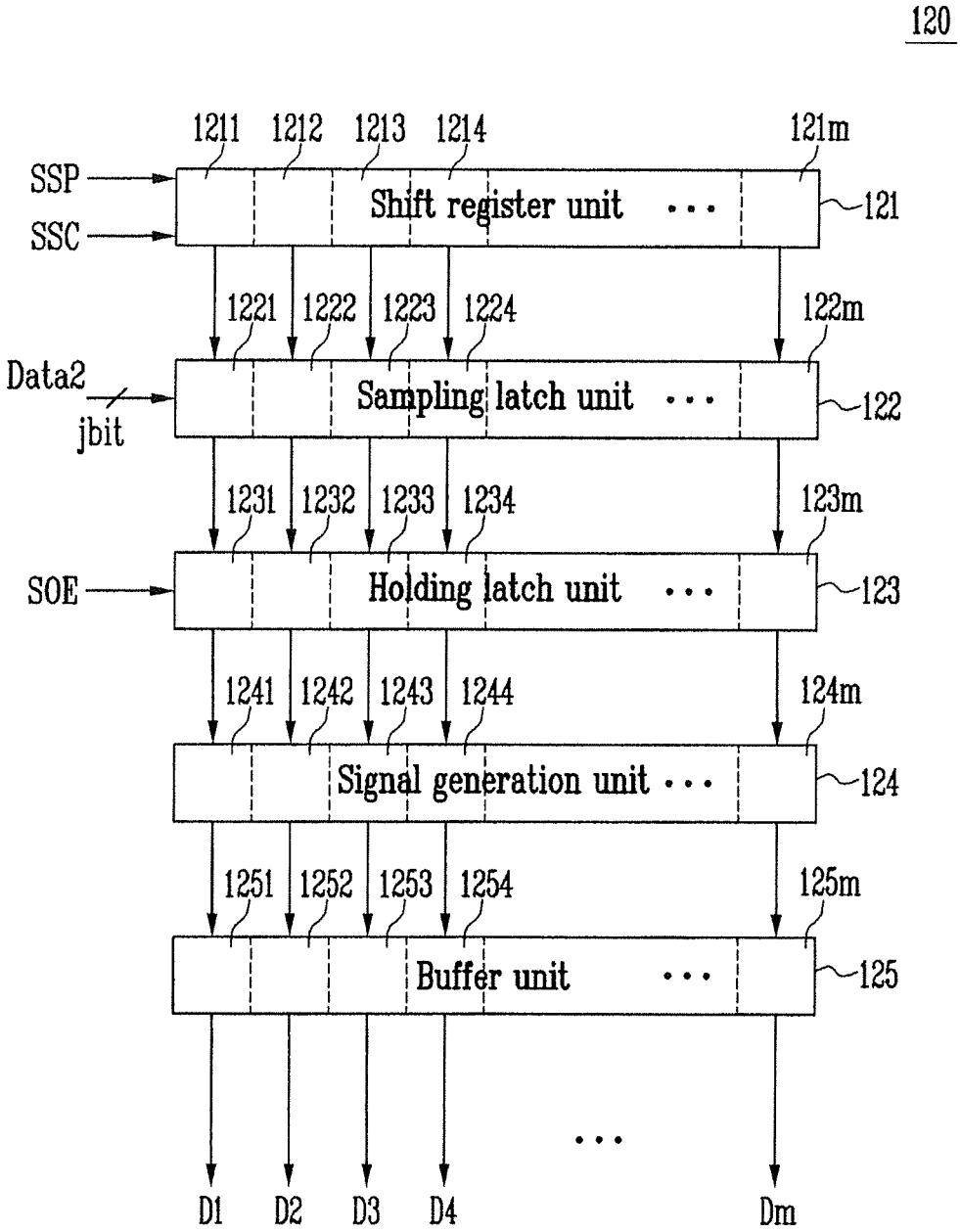
FIG. 6 is a schematic block diagram showing the data driver of FIG. 2.

FIG. 6 is a schematic block diagram showing an exemplary embodiment of a data driver.

Referring to FIG. 6, the data driver includes a shift register unit 121, a sampling latch unit 122, a holding latch unit 123, a signal generation unit 124, and a buffer unit 125.

The shift register unit 121 receives a source start pulse SSP and a source shift clock SSC from the timing controller 150. The shift register unit 121 supplied with the source shift clock SSC and the source start pulse SSP sequentially generates m sampling signals, while shifting the source start pulse SSP once per period of the source shift clock SSC. To this end, the shift register unit 121 includes m shift registers 1211 to 121*m*.

The sampling latch unit 122 sequentially stores the second data Data2 in response to the sampling signal supplied sequentially from the shift register unit 121. To this end, the sampling latch unit 122 includes m sampling latches 1221 to 122*m* in order to store m second data Data2.

The holding latch unit 123 receives a source output enable SOE signal from the timing controller 150. The holding latch unit 123 supplied with the source output enable SOE signal receives and stores the second data Data2 from the sampling latch unit 122. In addition, the holding latch unit 123 supplies the second data Data2 stored in itself to the signal generation unit 124. To this end, the holding latch unit 123 includes m holding latches 1231 to 123*m*.

The signal generation unit 124 receives the second data Data2 from the holding latch unit 123, and generates m data signals corresponding to the received second data Data2. To this end, the signal generation unit 124 includes m digital-analog converters (hereinafter, referred to as "DAC") 1241 to 124*m*. In other words, the signal generation unit 124 generates m data signals using DACs 1241 to 124*m* positioned at each channel, and supplies the generated data signals to the buffer unit 125.

The buffer unit 125 supplies the m data signals supplied from the signal generation unit 124 to m data lines D1 to Dm, respectively. To this end, the buffer unit 125 includes m buffers 1251 to 125*m*.

Figure 7:
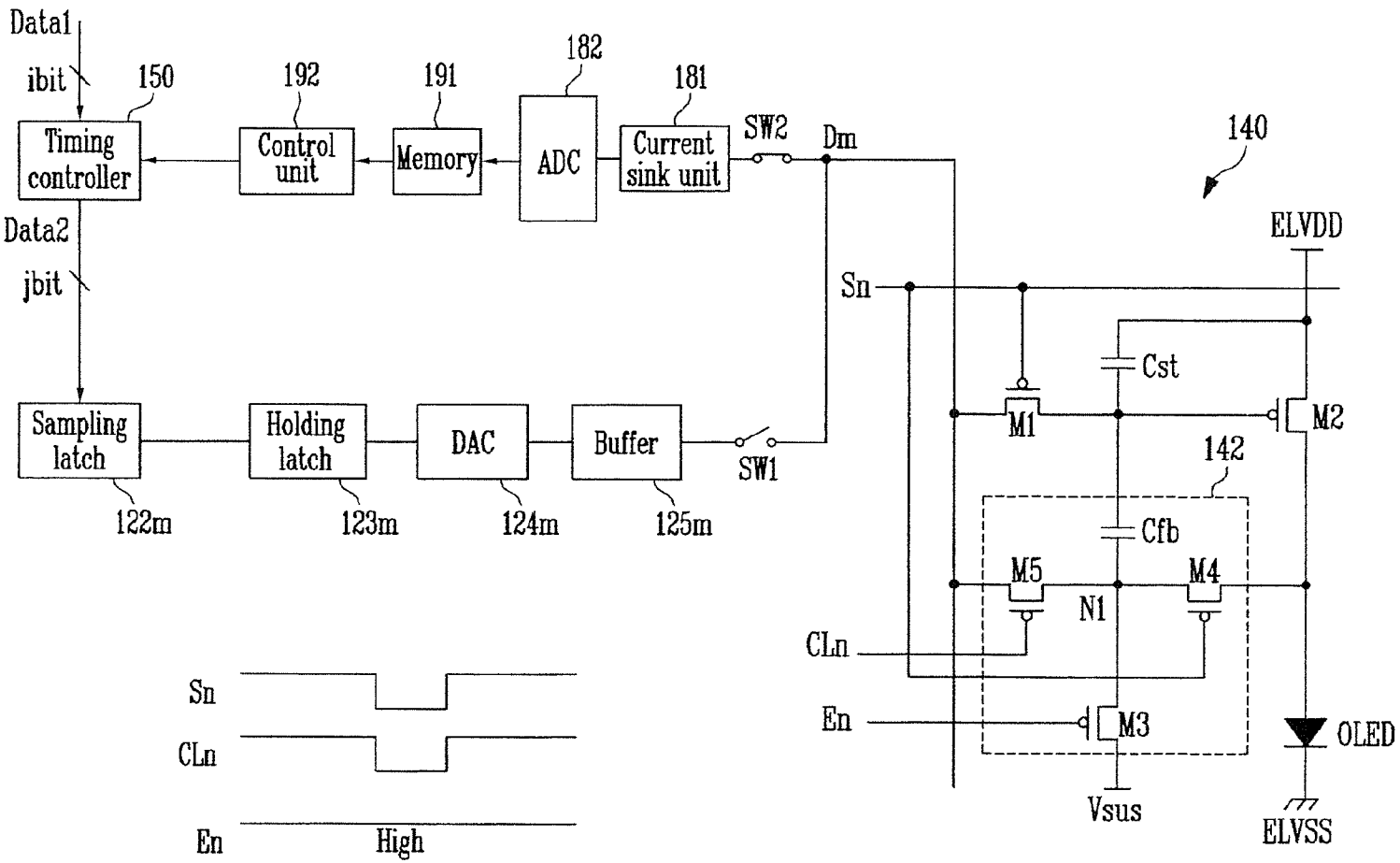
FIG. 7 is a schematic block diagram showing a driving waveform supplied during a compensation period of the threshold voltage and an operation process.

FIG. 7 is a schematic block diagram further showing a driving waveform supplied during a compensation period of the threshold voltage, during which the threshold voltage of a driving transistor is compensated.

Referring to FIG. 7, the scan driver 110 sequentially supplies the scan signals (e.g., having a low voltage) to the scan lines S1 to Sn during the compensation period of the threshold voltage. Also, the control line driver 160 sequentially supplies the control signals (e.g., having a low voltage) to the control lines CL1 to CLn substantially in synchronization with the scan signals. In this case, the control signal on a $k^{th}$ control line CLk overlaps with the scan signal on a $k^{th}$ scan line Sk.

During the compensation period of the threshold voltage, the emission control signals (e.g., having a high voltage) are on a plurality (e.g., all) of the emission control lines C1 to En so that the third transistors M3 included in each of the pixels 140 maintain a turn-off state. In addition, during the compensation period of the threshold voltage, the second switching element SW2 maintains a turn-on state.

Specifically describing the operation process of an exemplary embodiment, when the scan signal first appears on the $n^{th}$ scan line Sn, the first transistor M1 and the fourth transistor M4 are turned on. When the first transistor M1 is turned on, the gate electrode of the second transistor M2 is coupled (e.g., conductively coupled) to the data line Dm. If the fourth transistor M4 is turned on, the first node N1 is coupled (e.g., conductively coupled) to the second electrode of the second transistor M2.

The fifth transistor M5 is turned on by the control signal supplied to the control line CLn in synchronization with the scan signal. When the fifth transistor M5 is turned on, the first node N1 is coupled (e.g., conductively coupled) to the data line Dm.

Here, the current sink unit 181 sinks the first current from the first power supply ELVDD via the second switching element SW2, the fifth transistor M5, the fourth transistor M4, and the second transistor M2. When the first current is sunken in the current sink unit 181, the first voltage is applied to the data line Dm. Here, because the first current is sunken via the second transistor M2, the threshold voltage/mobility information of the second transistor M2 is included in the first voltage (in some embodiments, the voltage applied to the gate electrode of the second transistor M2 is used as the first voltage.)

The first voltage applied to the data line Dm is converted into the first digital value in the ADC 182 to be supplied to the memory 191, and accordingly, the first digital value is stored in the memory 191. Through the above-described process, in some embodiments, the first digital value including the threshold voltage/mobility information of the second transistors M2 included in all the pixels 140 is stored in the memory 191.

In an exemplary embodiment, the process of sensing the threshold voltage/mobility of the second transistor M2 is performed at least once before the organic light emitting display device is used. For example, before the organic light emitting display device is released from the manufacturer, the threshold voltage/mobility of the second transistor M2 may be sensed to be stored in the memory 191. Also, the process of sensing the threshold voltage/mobility of the second transistor M2 may also be performed at a time designated by a user.

Figure 8:
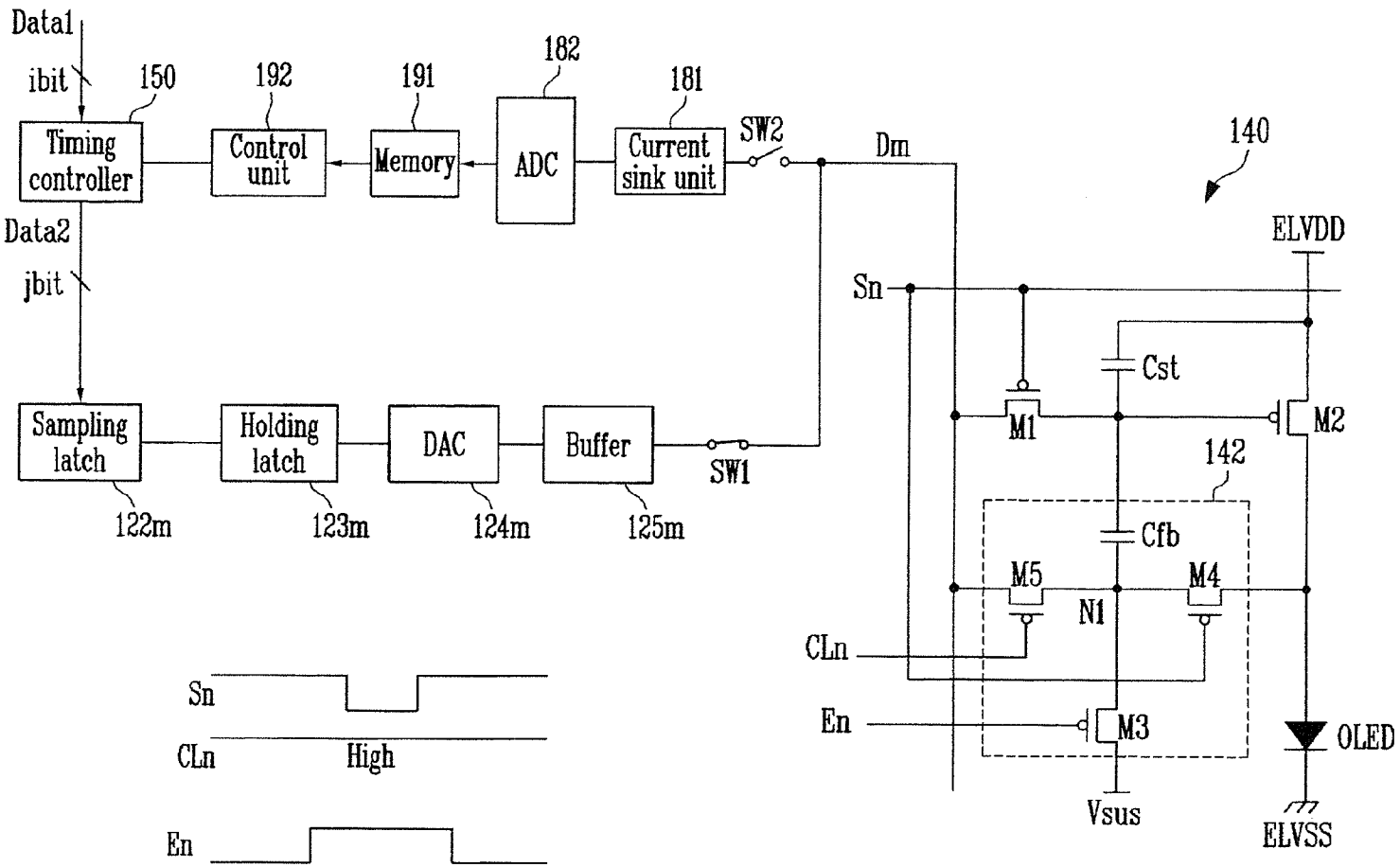
FIG. 8 is a schematic block diagram showing a driving waveform supplied during a normal driving period and an operation process.

FIG. 8 is a schematic block diagram further showing a driving waveform supplied during a normal driving period.

Referring to FIG. 8, during a normal driving period, the scan driver 110 sequentially supplies the scan signals to the scan lines S1 to Sn, and sequentially supplies the emission control signals to the emission control lines E1 to En. Here, the emission control signal on a $k^{th}$ emission control line Ek overlaps with the scan signal on a $k^{th}$ scan line Sk, wherein the emission control signal has a wider width than the scan signal. During the normal driving period, the control signals are not supplied to all the control lines CL1 to CLn (e.g., having a high voltage). Further, during the normal driving period, the first switching element SW1 maintains a turn-on state.

Specifically describing the operation process of an exemplary embodiment, when first being supplied to the pixel 140 coupled to the data line Dm and the scan line Sn, the first data Data1 is supplied to the timing controller 150. Here, the control unit 192 supplies the first digital value extracted from the pixel 140 coupled to the data line Dm and the scan line Sn to the timing controller 150.

The timing controller 150 supplied with the first digital value generates the second data Data2 by converting the bit value of the first data Data1. Here, the second data Data2 is such that the threshold voltage/mobility of the second transistor M2 can be compensated.

In an exemplary embodiment, when the first data Data1 having a binary value of "00001110" is input, the timing controller 150 generates the second data Data2 having a binary value of "000011110" to compensate for the deviation of the threshold voltage/mobility of the second transistor M2.

The second data Data2 generated by the timing controller 150 is supplied to the DAC 124*m* via the sampling latch 122*m* and the holding latch 123*m*. The DAC 124*m* thereafter generates the data signal using the second data Data2, and supplies the generated data signal to the data line Dm via the buffer 125*m*.

When first transistor M1 and the fourth transistor M4 maintain a turn-on state in accordance with the scan signal supplied to the scan line Sn, the data signal is supplied to the data line Dm. Here, the third transistor M3 is turned off in accordance with the emission control signal supplied to the emission control line En.

When the first transistor M1 is turned on, the data signal supplied from the data line Dm is supplied to the gate electrode of the second transistor M2. Thus, the storage capacitor Cst is charged with a voltage corresponding to the data signal. The fourth transistor M4 maintains a turn-on state during a period when the storage capacitor Cst is charged with a voltage (e.g., a predetermined voltage) so that the first node N1 receives the anode voltage Voled of the organic light emitting diode OLED.

After the storage capacitor Cst is charged with the voltage (e.g., the predetermined voltage), the supply of the scan signal to the scan line Sn stops. When the supply of the scan signal to the scan line Sn stops, the first transistor M1 and the fourth transistor M4 turn off.

Thereafter, the supply of the emission control signal to the emission control line En stops and the third transistor M3 turns on. When the third transistor M3 turns on, the voltage of the first node N1 becomes the voltage of the voltage source Vsus. For example, when the voltage of the voltage source Vsus is higher than the anode voltage Voled, the voltage of the first node N1 rises from the anode voltage Voled to the voltage of the voltage source Vsus. Here, the voltage of the gate electrode of the second transistor M2 also rises corresponding to the voltage of the first node N1. In this embodiment, the voltage of the voltage source Vsus is lower than that of the first power supply ELVDD so that the pixel displays a sufficient brightness.

Thereafter, the second transistor M2 supplies the current corresponding to the voltage applied to the gate electrode of the second transistor M2 from the first power supply ELVDD to the second power supply ELVSS via the organic light emitting diode OLED. Then, light (e.g., a predetermined amount of light) corresponding to the amount of current is generated by the organic light emitting diode OLED.

The organic light emitting diode OLED deteriorates as time elapses. Here, as the organic light emitting diode OLED deteriorates, the anode voltage Voled of the organic light emitting diode OLED rises. In other words, as the organic light emitting diode OLED deteriorates, the resistance of the organic light emitting diode OLED increases, and, accordingly, the anode voltage Voled of the organic light emitting diode OLED rises.

As the organic light emitting diode OLED deteriorates, the voltage of the first node N1 is lowered. In other words, as the organic light emitting diode OLED deteriorates, the anode voltage Voled of the organic light emitting diode OLED that is supplied to the first node N1 rises, and accordingly, the voltage of the first node N1 is lower than the voltage when the organic light emitting diode is not deteriorated.

If the voltage of the first node N1 is low, the voltage of the gate electrode of the second transistor M2 becomes low. Accordingly, the amount of current supplied by the second transistor M2 corresponding to the same data signal increases. In other words, in an exemplary embodiment of the present invention, as the organic light emitting diode OLED deteriorates, the amount of current supplied by the second transistor M2 increases to compensate for the deterioration of the organic light emitting diode OLED and accordingly reduce the lowering in brightness.

When the voltage of the voltage source Vsus is lower than the anode voltage Voled (in some embodiments, the voltage source Vsus is substantially the same as the voltage of the second power supply ELVSS), the voltage of the first node N1 falls from the anode voltage Voled to the voltage of the voltage source Vsus. At this time, the voltage of the gate electrode of the second transistor M2 also falls corresponding to the voltage of the first node N1.

As the organic light emitting diode OLED deteriorates, the anode voltage Voted of the organic light emitting diode OLED rises. In this case, as the organic light emitting diode OLED deteriorates, the voltage of the first node N1 rises. In other words, as the organic light emitting diode OLED deteriorates, the anode voltage Voled of the organic light emitting diode OLED that is supplied to the first node N1 rises and accordingly, the voltage of the first node N1 is higher than the voltage when the organic light emitting diode is not deteriorated.

If the voltage of the first node N1 is high, the voltage of the gate electrode of the second transistor M2 becomes high. Then, the amount of current supplied by the second transistor M2 corresponding to the same data signal increases. In other words, in an exemplary embodiment of the present invention, as the organic light emitting diode OLED deteriorates, the amount of current supplied by the second transistor M2 increases to compensate for the deterioration of the organic light emitting diode OLED and accordingly reduce the lowering in brightness.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a first transistor coupled to a scan line and a data line, the first transistor configured to be turned on when a scan signal is supplied to the scan line;

a storage capacitor for storing a voltage corresponding to a data signal supplied to the data line;

a second transistor for supplying a current corresponding to the voltage stored in the storage capacitor, the current flowing from a first power supply to a second power supply via the organic light emitting diode; and a compensation unit for controlling a voltage of a gate electrode of the second transistor corresponding to a deterioration of the organic light emitting diode, and for coupling a first electrode of the second transistor to the data line during a compensation period in which a threshold voltage of the second transistor is compensated, wherein the compensation unit comprises:

a fourth transistor and a fifth transistor, the fourth and fifth transistors being coupled between the first electrode of the second transistor and the data line; and a third transistor coupled between a first node and a voltage source, the first node being a common terminal of the fourth transistor and the fifth transistor.

2. The pixel as claimed in claim 1, wherein the compensation unit further comprises:

a feedback capacitor coupled between the first node and the gate electrode of the second transistor.

3. The pixel as claimed in claim 2, wherein a gate electrode of the fifth transistor is coupled to a control line substantially parallel to the scan line, such that the fifth transistor is configured to be turned on during the compensation period.

4. The pixel as claimed in claim 3, wherein a gate electrode of the fourth transistor is coupled to the scan line and is configured to be turned on during the compensation period, concurrently with the fifth transistor.

5. The pixel as claimed in claim 2, wherein a gate electrode of the third transistor is coupled to an emission control line substantially parallel to the scan line.

6. The pixel as claimed in claim 5, wherein a turn-on time of the third transistor does not overlap with a turn-on time of the fourth transistor during a normal driving period.

7. The pixel as claimed in claim 2, wherein the voltage source has a higher voltage than a voltage applied to an anode electrode of the organic light emitting diode.

8. The pixel as claimed in claim 2, wherein the voltage source has a lower voltage than a voltage applied to an anode electrode of the organic light emitting diode.

9. The pixel as claimed in claim 8, wherein a voltage of the voltage source is substantially identical to a voltage of the second power supply.

10. An organic light emitting display device comprising:

a plurality of scan lines, a plurality of emission control lines, and a plurality of control lines extending across a display region;

a plurality of data lines extending across the display region and crossing the scan lines, emission control lines, and control lines;

a plurality of pixels at respective crossings of the scan lines, emission control lines, control lines, and data lines;

a scan driver for sequentially supplying scan signals to the scan lines during a compensation period for compensating a threshold voltage and during a normal driving period, and for sequentially supplying emission control signals to the emission control lines during the normal driving period;

a control line driver for sequentially supplying control signals to the control lines during the compensation period;

a data driver for supplying data signals to the data lines, the data signals corresponding to second data supplied from a timing controller;

a sensing unit for sensing threshold voltage/mobility information of driving transistors in respective ones of the pixels;

a switching unit for selectively coupling the sensing unit and/or the data driver to the data lines;

a control block for storing the threshold voltage/mobility information of the driving transistors sensed by the sensing unit; and the timing controller for generating the second data in accordance with first data supplied from an external source utilizing the threshold voltage/mobility information stored in the control block, wherein each of the respective pixels comprises an organic light emitting diode and a compensation unit for coupling a respective one of the driving transistors to a respective one of the data lines during the compensation period and for compensating for a deterioration of the organic light emitting diode during the normal driving period, wherein the respective one of the driving transistors is coupled between a first power supply and a second power supply, and wherein the compensation unit comprises:

a fourth transistor and a fifth transistor, the fourth and fifth transistors being coupled between a data line of the data lines and the driving transistor; and a third transistor coupled between a first node and a voltage source, the first node being a common terminal of the fourth transistor and the fifth transistor.

11. The organic light emitting display device as claimed in claim 10, wherein the sensing unit comprises:

a current sink unit for sinking a first current from a specific pixel of the pixels via a specific driving transistor of the driving transistors in the specific pixel; and an analog-digital converter for converting a first voltage to a first digital value, the first voltage generated when the first current is sunken.

12. The organic light emitting display device as claimed in claim 11, wherein the switching unit comprises:

a second switching element between the current sink unit and the data line, the second switching element configured to be turned on during the compensation period; and a first switching element between the data driver and the data line, the first switching element configured to be turned on during the normal driving period.

13. The organic light emitting display device as claimed in claim 11, wherein the control block comprises:

a memory for storing the first digital value; and a control unit for transferring the first digital value to the timing controller.

14. The organic light emitting display device as claimed in claim 13, wherein the control unit is configured to transfer the first digital value generated from the specific pixel to the timing controller when the first data to be supplied to the specific pixel is input to the timing controller.

15. The organic light emitting display device as claimed in claim 13, wherein the timing controller is configured to generate the second data having j bits (j is a natural number greater than i) based on the first data having i bits (i is a natural number) utilizing the first digital value to compensate the threshold voltage/mobility.

16. The organic light emitting display device as claimed in claim 10, wherein during the normal driving period, the scan driver is configured to supply a first emission control signal of the emission control signals to a first emission control line of the emission control lines, the first emission control signal at least partially overlapping a first scan signal of the scan signals, the first scan signal supplied to a first scan line of the scan lines corresponding to the first emission control line, and having a wider width than a width of the first scan signal.

17. The organic light emitting display device as claimed in claim 16, wherein during the compensation period, the control line driver is configured to supply a first control signal of the control signals to a first control line of the control lines concurrently with a second scan signal of the scan signals supplied to a second scan line of the scan lines corresponding to the first control line.

18. The organic light emitting display device as claimed in claim 17, wherein each of the respective pixels further comprises:

a first transistor coupled to a respective scan line of the scan lines and a respective data line of the data lines, the first transistor configured to be turned on when a scan signal of the scan signals is supplied to the respective scan line;

a storage capacitor for storing a voltage corresponding to a data signal of the data signals supplied to the respective data line; and the respective one of the driving transistors for supplying a current corresponding to the voltage stored in the storage capacitor from the first power supply to the second power supply via the organic light emitting diode, wherein a voltage of a gate electrode of the driving transistor is controlled by the compensation unit.

19. The organic light emitting display device as claimed in claim 18, wherein the compensation unit comprises:

the fourth transistor coupled to a first electrode of the driving transistor, the fourth transistor configured to be turned on when the scan signal is supplied to the respective scan line;

the fifth transistor coupled between the fourth transistor and the data line, the fourth transistor configured to be turned on when the control signal is supplied to the respective control line;

the third transistor coupled between a first node and a voltage source, the first node being a common terminal of the fourth transistor and the fifth transistor, the third transistor configured to be turned on when an emission control signal of the emission control signals is supplied to a respective emission control line of the emission control lines; and a feedback capacitor coupled between the first node and a gate electrode of a second transistor.

20. The organic light emitting display device as claimed in claim 19, wherein the voltage source is configured to supply a higher voltage than a voltage applied to an anode electrode of the organic light emitting diode.

21. The organic light emitting display device as claimed in claim 19, wherein the voltage source is configured to supply a lower voltage than a voltage applied to an anode electrode of the organic light emitting diode.

22. The organic light emitting display device as claimed in claim 21, wherein the voltage source is configured to supply a voltage substantially identical to a voltage supplied by the second power supply.

* * * * *